US008505789B2

(12) United States Patent
Green

(10) Patent No.: US 8,505,789 B2
(45) Date of Patent: Aug. 13, 2013

(54) RESCUE BAG

(75) Inventor: Chad Merritt Green, Linden, MI (US)

(73) Assignee: Chad Merritt Green, Linden, MI (US)

( * ) Notice: Subject to any disclaimer, the term of this patent is extended or adjusted under 35 U.S.C. 154(b) by 267 days.

(21) Appl. No.: 12/876,938

(22) Filed: Sep. 7, 2010

(65) Prior Publication Data

US 2012/0145754 A1 Jun. 14, 2012

Related U.S. Application Data

(60) Provisional application No. 61/275,944, filed on Sep. 4, 2009.

(51) Int. Cl.
*A61G 1/00* (2006.01)

(52) U.S. Cl.
USPC ..... 224/158; 224/610; 224/614

(58) Field of Classification Search
USPC ..... 224/158–161, 607, 610–612, 614, 224/620, 250, 257; 2/69.5, 81, 458, 82; 5/483, 5/628, 629, 625
See application file for complete search history.

(56) References Cited

U.S. PATENT DOCUMENTS 4,442,557 A * 4/1984 Clemens ..... 5/625
4,996,099 A * 2/1991 Cooke et al. ..... 442/4
5,091,243 A * 2/1992 Tolbert et al. ..... 442/60
5,249,321 A * 10/1993 Graf ..... 5/494
5,289,959 A * 3/1994 Beeley et al. ..... 224/160
5,309,571 A * 5/1994 Huang ..... 2/458
5,797,528 A * 8/1998 McDuffie ..... 224/148.4
5,921,388 A * 7/1999 Petrilli et al. ..... 206/321
6,195,822 B1 * 3/2001 Sorensen et al. ..... 5/628
7,128,207 B2 * 10/2006 Anderson et al. ..... 206/223
2007/0136950 A1 * 6/2007 Zuercher ..... 5/627
2007/0234464 A1 * 10/2007 Iwasiuk ..... 2/82
2007/0278263 A1 * 12/2007 Zak et al. ..... 224/160

* cited by examiner

*Primary Examiner* — Justin Larson
*Assistant Examiner* — Corey Skurdal

(57) ABSTRACT

A fire and heat resistant rescue device designed to offer a safe and effective means to protect and remove, during an emergency, infants, toddlers, children or other persons from hazardous atmospheres which may include heat, flame, toxic gases and fumes, hazardous materials, and other dangerous exposures. This design was developed to give a firefighter/rescuer a way to safely move a potential victim through a dangerous environment found during a house or structure fire, but also has broader rescue and situational uses when protecting and moving a victim from a hazardous area. This device uses compressed air, when required, to supply slight positive air pressure inside the bag, thus excluding entry of heat, smoke, and other hazards. It is designed to function as a raising or lowering device when needed. It is also designed to allow the rescuer to perform CPR in non hazardous atmospheres, when required.

14 Claims, 9 Drawing Sheets

| Drawing Reference Number | Component Name, etc. |
|---|---|
| 1 | Firefighter/rescuer |
| 2 | Rescue bag |
| 3 | Quick-fill/auxiliary air line |
| 4 | Strap, front portion |
| 5 | Strap, rear portion |
| 6 | Front bail |
| 7 | Rear bail |
| 8 | Flap interface region, head end panel |
| 9 | Snap used after folding rescue bag |
| 10 | Light reflective strip |
| 11 | Handle for opening top panel |
| 12 | |
| 13 | Support belt, first |
| 14 | Auxiliary air line connecting fitting |
| 15 | Interior space of rescue bag |
| 16 | Interface region, first side panel |
| 17 | Interface region, second side panel |
| 18 | Interface region, head end panel |
| 19 | Foot/second end of top panel |
| 20 | Head/front end panel |
| 21 | Foot/rear end panel |
| 22 | First side panel |
| 23 | Second side panel |
| 24 | Top panel |
| 25 | Head/first end of top panel |
| 26 | Front strap loop |
| 27 | Rear strap loop |
| 28 | Support belt, second |
| 29 | Second support belt-to-bail transition |
| 30 | First snap |
| 31 | Second snap |
| 32 | Folded and snapped rescue bag |
| 33 | Top of first side panel |
| 34 | Top of second side panel |
| 35 | Bag-carrying shoulder strap |
| 36 | Front strap loop securing feature |
| 37 | Rear strap loop securing feature |

FIG. 8 A

| Drawing Reference Number | Component Name, etc. |
|---|---|
| 38 | Eyelet or tie-off point |
| 39 | Relief valve |
| 40 | Bottom panel |
| 41 | Bottom panel reinforcement |
| 42 | Compressed air canister/cylinder |
| 43 | Air regulator/metering device |
| 44 | Air gauge |
| 45 | Self Contained Breathing Apparatus |
| 46 | Outer shell |
| 47 | Interior side of top panel |
| 48 | Head/front end of bag |
| 49 | Foot/rear end of bag |
| 50 | Head of person being rescued |
| 51 | Ends of the support belts |
| 52 | Rescue bag longitudinal axis |
| 53 | Rescue bag lateral axis |
| 54 | Rescue bag vertical axis |
| 55 | Panel interfaces |

FIG. 8 B

RESCUE BAG

This application claims the benefit of U.S. Provisional Patent Application Ser. No. 61/275,944, filed Sep. 4, 2009 by the present inventor, which is incorporated by reference.

FEDERALLY SPONSORED RESEARCH

Not Applicable.

SEQUENCE LISTING OR PROGRAM

Not applicable

BACKGROUND OF THE INVENTION

1. Field of the Invention

The present invention relates to a protective enclosure for limiting, or excluding, a person's exposure to heat, smoke, soot, dust and other environmental hazards during fire or other emergency where a hazardous atmosphere is found, and/or where a victim is in need of being rescued and/or moved.

Victims found in house fires and other hazardous environments, are most often simply dragged or carried by rescuers unprotected to safety. During rescue victims may suffer injuries to the exterior and interior of their bodies. The problem could be partially solved by fire blankets, but this only addresses protection to the exterior of a victim, i.e. skin. Protective hoods also partially solve the problem, but only protect the head, face, and breathing air and leave the body unprotected. Finally fully encapsulating suits have been introduced, but are impractical and difficult to use during a fire rescue emergency and provide inferior fire and heat protection.

2. Description of Related Art

There a variety of fire escape and protective devices used for self rescue or the rescuing of a victim by carrying, dragging, or lowering victims from hazardous areas or multi level structures. These range from fire blankets, fire resistive wraps, fire hoods, lowering harnesses and transport devices.

Examples of such devices may be seen in U.S. Pat. Nos. 6,102,128; 5,309,571; 6,195,822; and patent application US 2007/0234464 A1. However none of these patents disclose devices able to perform in a professional fire and rescue capacity, where it is important to perform several or all of these needs together. A means of securing a patient in a thermally protective encapsulating device, providing safe breathing air, be easily deployed in limited visibility situations and can then be easily carried by a rescuer, or lowered/raised using ropes or cables.

Consequently, there is a need for an improved rescue device for firefighters or rescuers to protect a person's body and air supply, and to function as a portable and secure carrying, raising, and lowering device when moving victims found in structural fires or other hazardous atmospheres. This device is needed to be portable, stow able, manageable with bulky protective gloves, and operable in limited visibility situations.

BRIEF SUMMARY OF THE INVENTION

3. Object of the Invention

This fire and heat resistant rescue bag device is designed to fulfill the need to have a safe and effective way to protect and then remove, during an emergency, infants, toddlers, children or other persons from hazardous atmospheres which may include heat, flame, toxic gases and fumes, hazardous materials, and other dangerous exposures that the design of this protective device is able to provide protection from. This design was developed to give a firefighter/rescuer a way to safely move a potential victim through a dangerous environment found during a house or structure fire, but also has broader rescue and situational uses where protecting and moving a victim from a hazardous area or atmosphere.

This design could include a compressed air canister to supply positive air pressure inside the bag, although such an air canister is not required. Alternatively, the bag could be connected to an external air source such as a firefighter's self-contained breathing apparatus (SCBA), or a combination of both a canister inside the bag and an SCBA.

When outside of a hazardous atmosphere, the design of the bag will also allow for a user to administer CPR (cardiopulmonary resuscitation) when needed. Under these circumstances the bag may be positioned in front of the user with the victim inside. The bag's double-zippered top may then be unzipped completely or partially, allowing for victim contact.

In one embodiment the device functions as a lowering or raising device, or used in a situation where a victim needs to be moved from one place to another with the use of rope, cable, etc. The design features a strong and secure tie-off point or points which, when attached safely to a rescue rope, could be used to lower, raise, or move the victim to safety. This could be used to lower a victim from a rooftop or window, or raising the victim from a "below grade" area such as a well or a basement or any other situation where the victim needs to be securely moved from one point to another. A clip-on or integral L.E.D. strobe light may be used for sight recognition while performing operations in darkened conditions.

The bag is designed with trained firefighters and rescue personnel as the primary users, but could also be used in other situations. For infants and toddlers, the bag may be about 32 inches long, about 14 inches wide, and about 11 inches tall but could be tailored to various sizes depending on a specific need or size requirements. A typical victim weight may be less than 35 pounds (lbs). Aside from infants; the bag could also be used to rescue live small animals or pets, or full grown adults, or any object requiring protection from a hazardous environment.

Following National Fire Protection Association (NFPA) 1971 standards for firefighter turnout clothing, the bag may be comprised of three components: an outer shell, a moisture barrier, and a thermal barrier. It may be made using the same materials used in manufacturing firefighter turnout gear.

The design of the device allows it to fold for easy storage. While folded, the shoulder strap is still exposed for ease of carrying, or is stored inside a protective sleeve with an attached carrying strap. The bag is primarily designed to be stored on rescue vehicles and fire apparatus and, using the materials described herein, is very durable.

BRIEF DESCRIPTION OF THE SEVERAL VIEWS OF THE DRAWINGS

FIGS. 8A and 8B are tables with some of the components for the rescue bag.

DETAILED DESCRIPTION OF THE INVENTION

Figure 1:
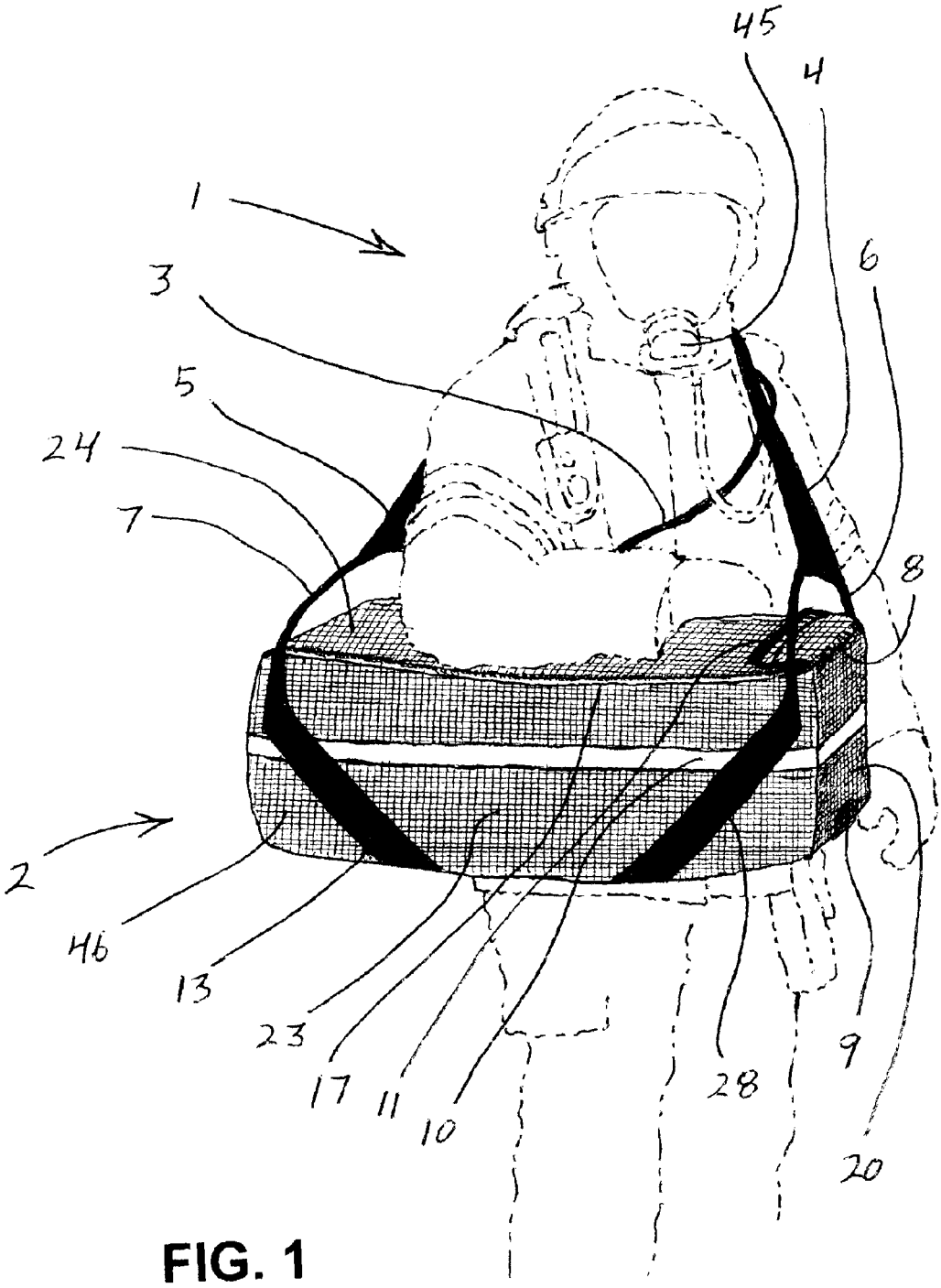
FIG. 1 is a perspective view of a first embodiment of the rescue bag in use by a rescuer, with the top panel closed.

Referring to FIG. 1, first person/rescuer 1 is shown carrying rescue bag 2 containing a second person (not shown). Top panel 24 of rescue bag 2 is shown in a closed position, so that the person inside the bag can be safely transported from a hazardous environment.

Referring to FIGS. 1-3 and 6, bag or container or enclosure 2 is comprised of head end panel 20, foot end panel 21, first and second side panels 22, 23, top panel 24 and bottom panel 40, wherein the panels are substantially connected to form interior space or chamber 15.

The panels may be connected in various ways, including (separately or in any combination) sewing, stitching, gluing, adhering, sealing, mechanical fastening, plastic welding, ultrasonic welding, etc.

Figure 6:
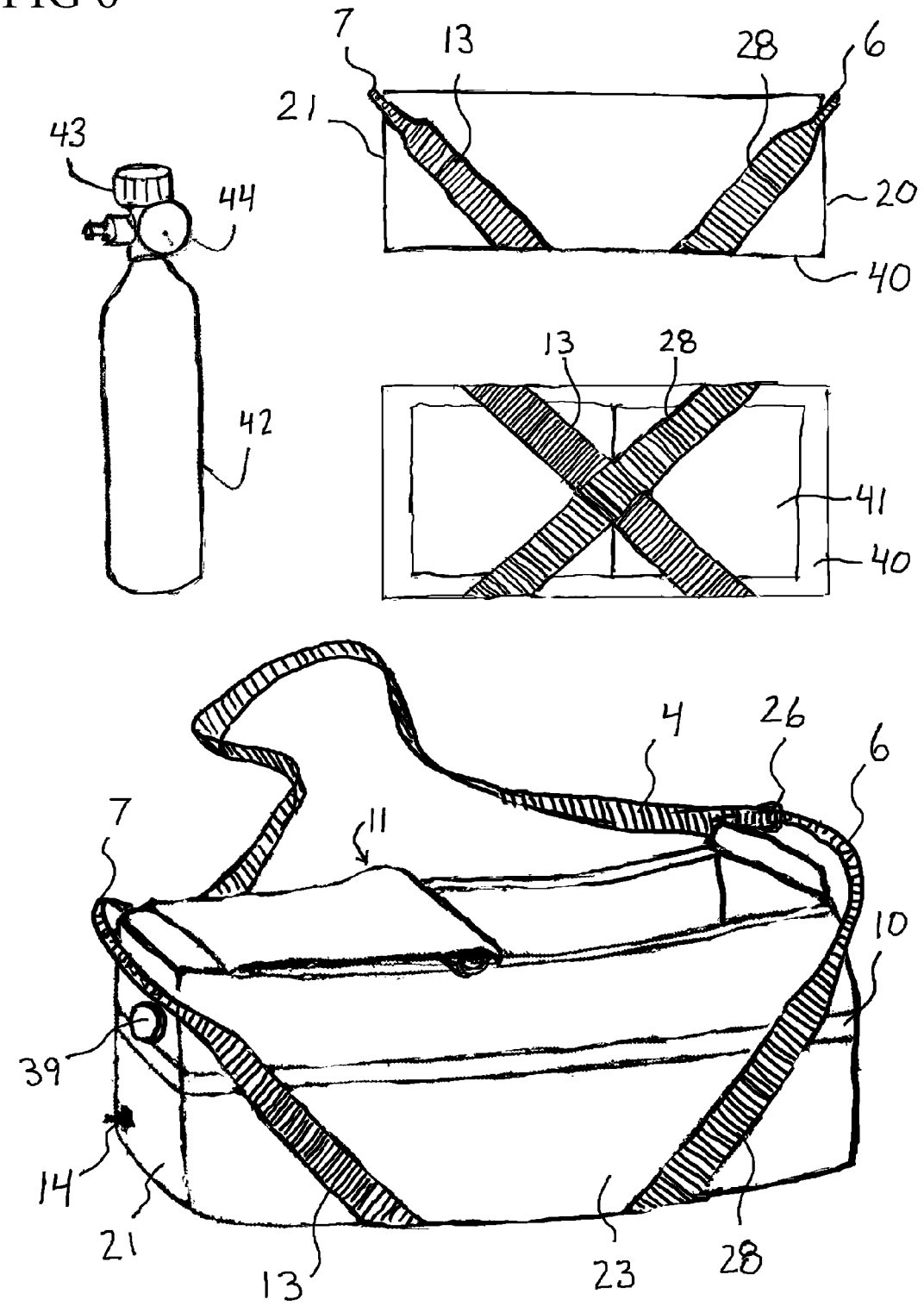
FIG. 6 shows perspective and bottom views of a fourth embodiment of the bag, a side view of the support belts without the side panels, and a perspective view of a compressed air canister for use with the bag.

First and second support belts 13, 28 substantially attach to and substantially undergird the bag, as shown in FIGS. 1 and 6. The support belts may be fabricated of nylon webbing or the fire-resistant materials described herein, or other fire-resistant materials. The purpose of the support belts is to provide the necessary strength to the overall design so that the weight of the person inside it can be supported and distributed within the bag, while allowing materials of lower strength (if desired) to form the enclosure of the bag.

Figure 3:
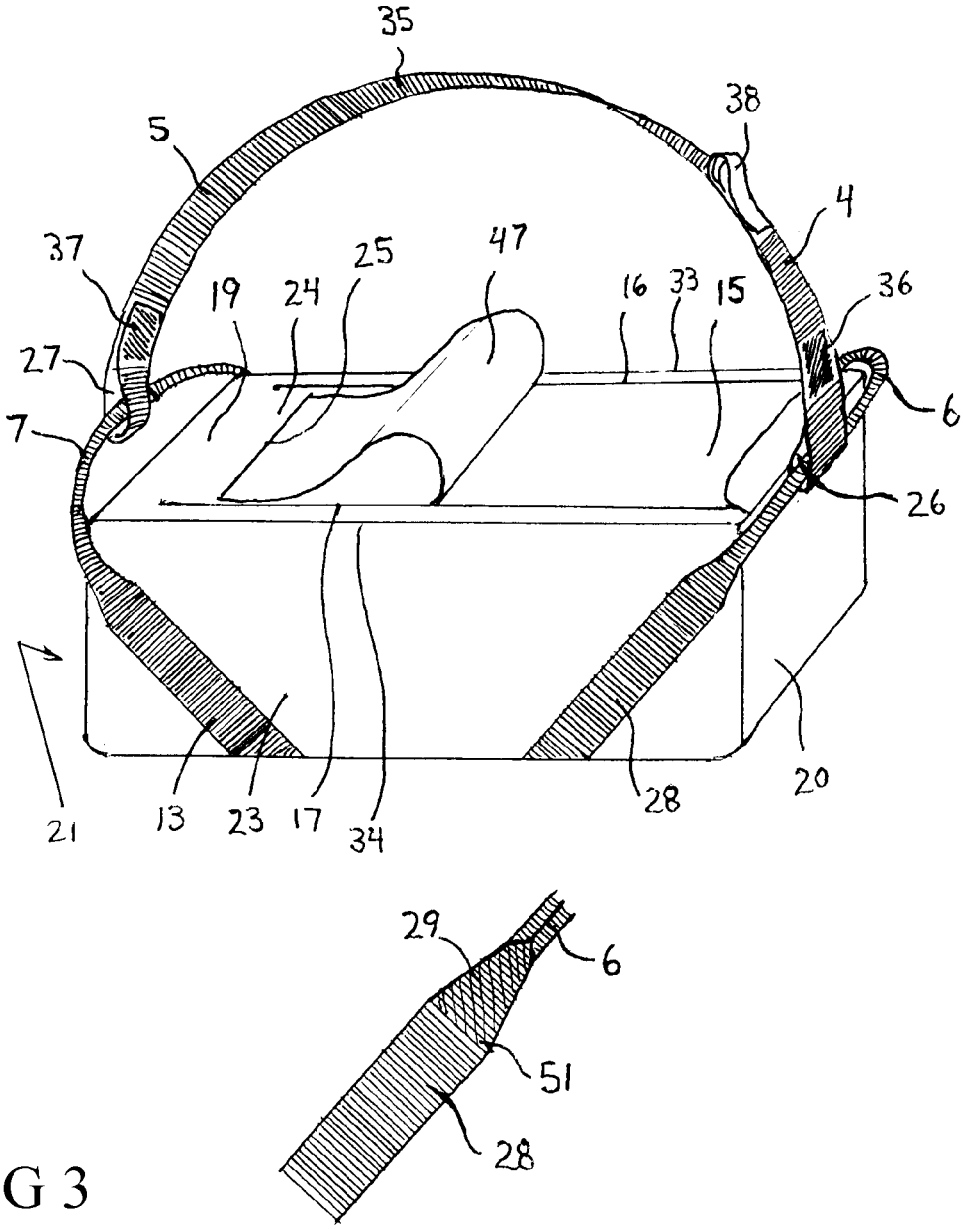
FIG. 3 is a perspective view of a second embodiment of the rescue bag with the top panel open.

Referring to FIG. 3, the first and second support belts further form front and rear bails 6, 7 or strap 2 at the top of the bag at ends 51 of the support belts. The bails may be arcuate in shape (at least before the bag is put into use). The bails may also be of other shapes, somewhat dependant on the material (s) they are made of, such as substantially half-circle, "D"-shaped, rectangular, triangular, oval, etc. The bails permit the positions of the ends of the strap to be shifted appropriately for best supporting the weight of the person inside the bag, depending on the manner of carrying used by the rescuer. Furthermore, the bails may be located elsewhere on the bag, such as at the middles or bottoms of their respective end panels. The bails may also be located at the side panels if desired, at the top, middle or bottom of each side panel. The bails may also be formed of various materials, and may be constructed separately from the support belts. For example, the bails may be made of Kevlar®, metal, fire-resistant plastic or fiber reinforced composites, braided materials, etc., and attached to the bag. Furthermore, it is contemplated that other structures in addition to bails may be used to implement attaching the strap to the bag. This includes connecting the strap directly to the bag without the use of bails, attaching the strap using high temperature plastic or metal eyelets, ball-and-socket rod ends, or pivoting button arrangements such as those used to connect a strap to a guitar. Other mechanisms for connecting the strap to the bag, either permanently or semi-permanently, may be employed, including clasps, hooks, buttons and other various quick release mechanisms.

Figure 5:
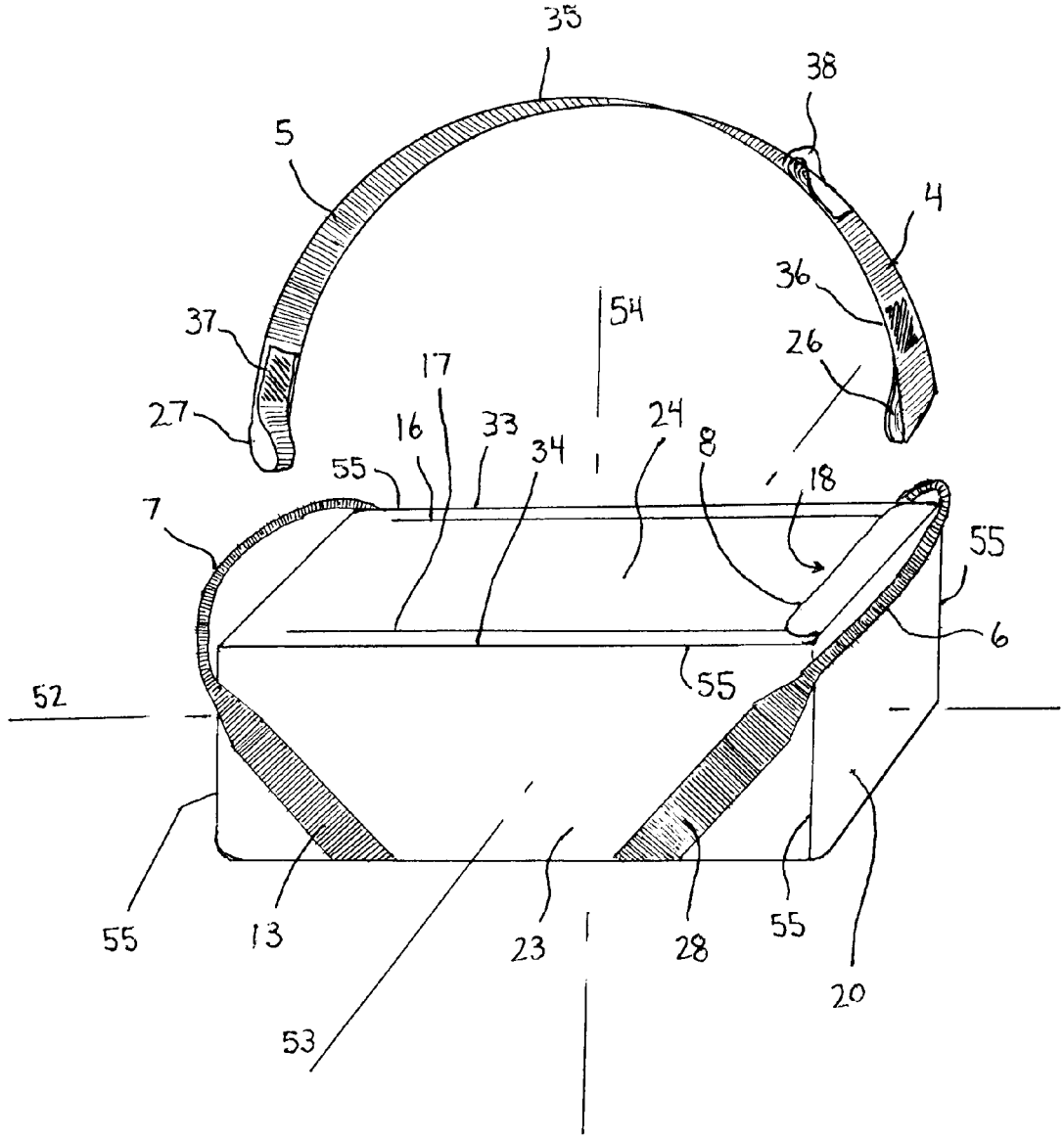
FIG. 5 is a perspective view of a third embodiment of the rescue bag with the top panel closed, showing the strap separately from the bag.

Referring to FIGS. 3 and 5, the strap may have front and rear portions 4, 5 with strap loops 26, 27 that substantially encircle the front and rear bails, respectively, in order to connect the bag and strap. The strap may be fabricated of nylon webbing or the fire-resistant materials described herein, or other fire-resistant materials.

Figure 2:
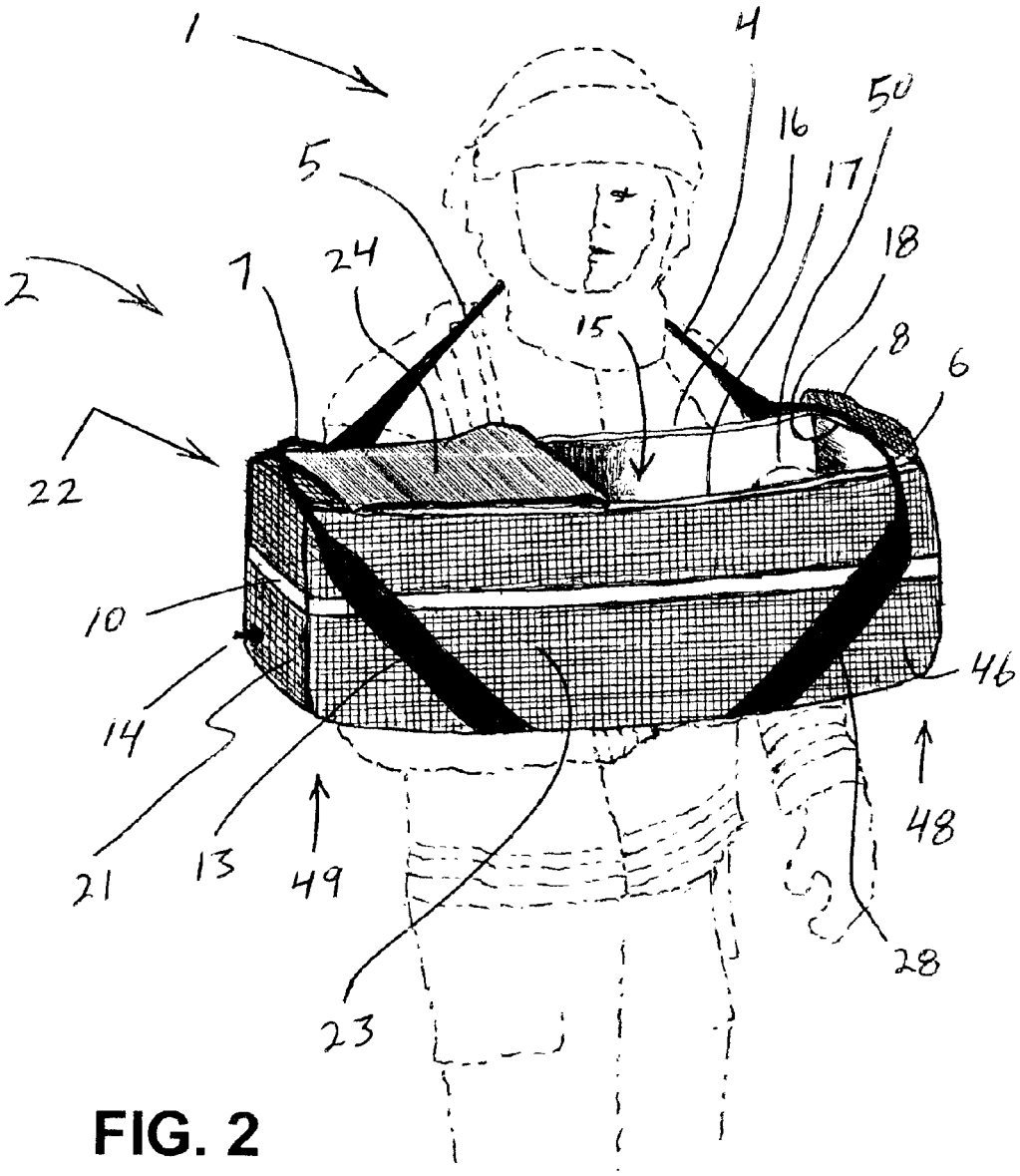
FIG. 2 is a perspective view of the first embodiment in use by a rescuer, with the top panel open.

Referring to FIGS. 1-2, light reflecting strip 10 may be used on the bag at one or more locations to help locate the bag in low light/low visibility conditions.

Referring to FIGS. 1-2, at least one closure device (not shown) is employed at interface region 17 between top panel 24 and side panel 23, at interface region 16 between top panel 24 and side panel 22, and at interface region 18 between top panel 24 and head end panel 20. These interface regions may be relatively wide so that, for example, the closure device operates substantially inboard of the side or end panels by about 0.5 inch to about four inches or more. Alternatively, these interface regions may be less than about 0.5 inch, and may even be substantially the top edges of the side or end panels, as long as the interface regions facilitate operation of the closure device(s) in opening and closing the interior chamber of the bag.

The closure device(s) may be any one or any combination of the following: a zipper, snap, button, adhesive, interference fit, latch, clasp, mating fasteners, Ziploc® seal and hook and-loop fastening material. The closure device may be one zipper extending substantially around the perimeter of the opening of the interior chamber. Alternatively, it may be a double zipper (ex. a single zipper adjacent the top of each side panel) together with a Velcro® portion that at least partially closes the head end of the top panel and the head end panel. Other zipper arrangements are possible. In another instance, a durable, semi-permanent adhesive sealing material (i.e. capable of more than a single use) may be employed to provide the desired closing and/or sealing function. In another instance, an adhesive sealing material capable of a single use may be employed to provide the desired closing and/or sealing function. Even if the sealing is of limited durability, it may provide adequate closing and/or sealing together with the advantage of simply pressing, for example, on the top panel (or its perimeter) to create the closure, without other motions such as translating the rescuer's hand across the top of the bag along longitudinal axis 52 (see FIG. 5). Numerous other combinations are contemplated by this invention. To facilitate movement of the top panel and opening of the chamber, handle 11 may be employed as shown in FIGS. 1 and 6. The handle may be used to transfer force to a double zipper arrangement, in order to permit opening and closing of the entrance of the interior chamber when the top panel is displaced by the rescuer.

Referring to FIG. 6, the bag may have relief valve 39 for passing gas from interior chamber 15 to the surrounding atmosphere when top panel 24 is closed and the interior chamber is pressured by air canister 42. A relief valve from the interior chamber to the atmosphere may be useful in various situations. For example, one may be used for a combination of panel materials and closure device(s) that tend to have a greater sealing effect, but where it is not desired that the bag become "balloon-like" (i.e. fairly rigid or difficult to handle or susceptible to relatively sudden collapse upon puncture). The bag may be designed to inherently control gas leakage from the interior chamber at a selected level, by the closure device(s) chosen and the material(s) chosen for the panels, panel interfaces (see 55 in FIGS. 5-6), interface regions, etc. Relief valve may also be a check valve, or a separate relief and check valves may be used.

Referring to FIG. 6, bottom panel 40 may have reinforcement 41, which is intended to support and distribute (across the bottom panel, support belts, etc.) at least a portion of the weight of the person being carried in the bag by the rescuer.

The reinforcement may be made of any suitable relatively stiff, lightweight material such as a fire-resistant polymer, plastic, nylon, fiber reinforced composite, fiberboard, Kevlar®, etc. Alternatively, the reinforcement would be designed so as to permit the rescuer to cradle the person's head, for effective administration of CPR, etc. This may be done by not extending the reinforcement into the general region where the person's head is expected to be located, or providing a cut-out in that general region.

The bag is may be constructed of a heat-resisting material (or materials), and may also be constructed of a heat-insulating material (or materials), or both heat-resisting and heat-insulating materials. First, the bag's material may have sufficient thermal integrity to withstand the ambient air temperatures in a building on fire, for example. Second, the material may have sufficient thermal insulation properties to help keep the ambient air temperature in the bag from becoming elevated, excessive or even dangerous for the person being transported. It is further contemplated that a smoke-resistant material may be used, also for the protection of the person being carried.

The panels may be substantially made of multiple layers of material, using either the same material or different materials having various advantageous properties. These multiple layers may be quilted, stitched, mechanically fastened, adhered, heat bonded, welded or riveted together (depending on the material properties of the layers) to prevent separation and "puckering" of the layers that could interfere with the space available in the interior chamber, that would make it more difficult to put the rescued person inside the bag.

Furthermore, the panels could be substantially made of one or more multilayer materials. Specialty materials as described herein are available to meet the temperature, air diffusion characteristics, etc. which are needed.

The panels may have a shell, a moisture barrier and a thermal barrier, or any one or any combination or any order thereof. Typically the moisture barrier is between an outer shell and the thermal barrier. However, the shell may also be an inner shell, or there may be a combination of inner and outer shells. The moisture barrier may be the external layer of the bag, the internal layer which forms the wall of the internal chamber, or between other material layers. Any suitable material or combination of materials which protects a person being rescued is contemplated.

Typically the shell may be made of a Kevlar®/Nomex® "Ripstop" blend or a polybenzimidazole fiber (PBI®), and may alternatively have a water-repellent finish. Other possible materials include aluminized silver, aluminized PBI, PBI blends, Aramid®, Aramid/PBI blends, flame-retardant (FR) cotton, Lenzing FR®, MicroTwaron™, Celazole® T-Series, polyetheretherketone polymers (PEEK), the materials used in aircraft firefighting turnout gear, and any combinations or blends of the above materials. It is also contemplated that the moisture barrier and/or thermal barrier may be formed of any of these materials/finishes, or any combination of these materials/finishes, in addition to other materials/finishes.

The rescue bag may include a compressed gas canister, wherein the canister supplies a gas to the interior chamber. Typically the canister does not supply gas at a rate (given the gas leakage characteristics of the overall design) which causes the outer surfaces of the bag to become excessively hard so that the bag is difficult for the rescuer to handle, or readily subject to being punctured and rapidly deflated.

The overall rescue bag system may be designed so as to produce a relatively compliant or "soft" bag. Alternatively, the system may be designed so as to produce a relatively "hard" bag, so long as it is not difficult for the rescuer to handle, or readily subject to being punctured and rapidly deflated. In one embodiment the canister supplies a gas mixture similar to atmospheric air to the interior chamber. In one embodiment the canister supplies a gas mixture which is substantially atmospheric air to the interior chamber.

For other embodiments, gas mixtures with greater levels of oxygen than atmospheric air, or other gas mixtures, are contemplated. The canister, having a valve and not having a separate gas regulator, may maintain a pressure in the bag which is greater than atmospheric pressure for at least a period of time when the interior chamber is closed. The air canister for the rescue bag system is capable of pressurizing the interior chamber as described herein and also supplying up to about 40 liters per minute of gas (ex. air or air mixture) for an adult person to breathe.

The air canister may also be designed to supply up to about 20 liters per minute of gas (ex. air or air mixture) for a baby or infant to breathe.

The size of the air canister may be about the size of a pressurized canister for a paintball gun, or it may be a different size.

The compressed gas canister may include a gas regulator.

In one embodiment, the regulator is set by the rescuer to a selected substantially fixed level of gas flow (for a selected period of time), wherein the selected level is intended to provide the desired "positive" pressure (i.e. above atmospheric pressure) within the bag.

In another embodiment, the regulator is set to a selected substantially fixed level of gas flow (for a selected period of time) upon some condition of preparing the bag for use, such as unfolding the bag or opening one of its panels. These embodiments may alternatively be used with relief valve 39.

In another embodiment, the regulator does not control the gas pressure within the bag.

The compressed gas canister may also include a check valve.

In another embodiment, the regulator produces a substantially variable level of gas flow, wherein the regulator controls the gas pressure within the bag for at least a period of time.

The regulator may use a mechanical, electromechanical, electronic and/or pneumatic device to accomplish this.

The system may alternatively employ a feedback control device to accomplish this.

These embodiments may alternatively be used with relief valve 39.

A gas regulator separate from the canister and in fluid communication with it may maintain a pressure in the bag which is greater than atmospheric pressure when the interior chamber is closed.

Figure 7:
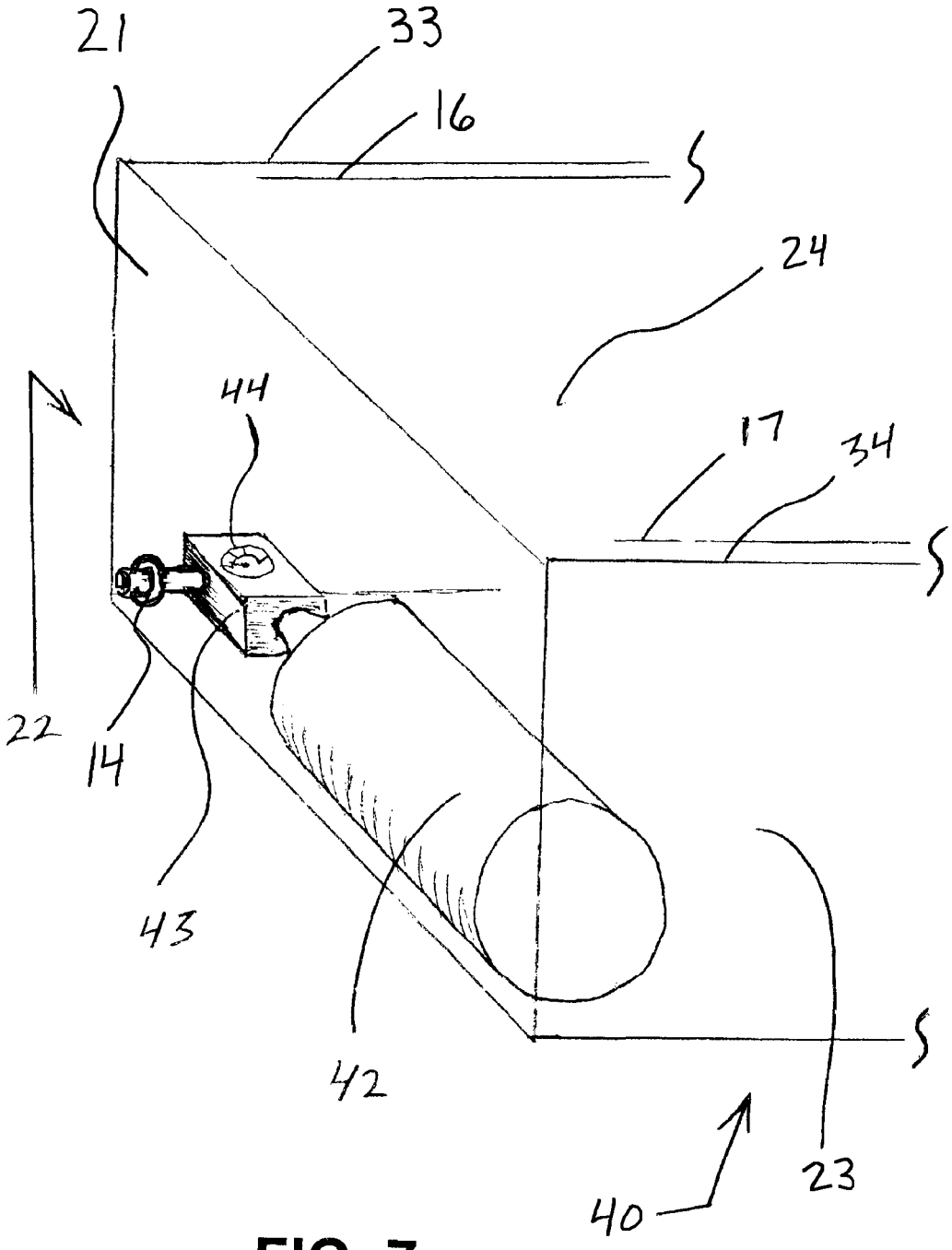
FIG. 7 is perspective view of an air canister within the bag.

Referring to FIG. 7, canister 42 is shown adjacent bottom panel 40 near foot end panel 21. In this configuration, the canister may pressurize the interior chamber and not interfere with placing a person inside the bag. Furthermore, locating the canister within the bag helps prevent the canister from being heated by ambient air or hot zones and becoming overpressurized.

The canister may also be located in a separate chamber inside the bag, or outside the bag but still substantially attached to it. Or the necessary air pressure may be supplied by an SCBA via quick-fill/auxiliary air line 3 as shown in FIG. 1.

Some victims may be afraid of being placed in the interior of a bag that is relatively dark when substantially closed. At least one panel or window or covered peephole constructed wholly or partly of a substantially translucent or substantially transparent material is contemplated, such as a high temperature polymer or glass or translucent fabric. Alternatively, a light source placed within the bag is contemplated, whether or not see-through materials, windows etc. are employed.

Figure 4:
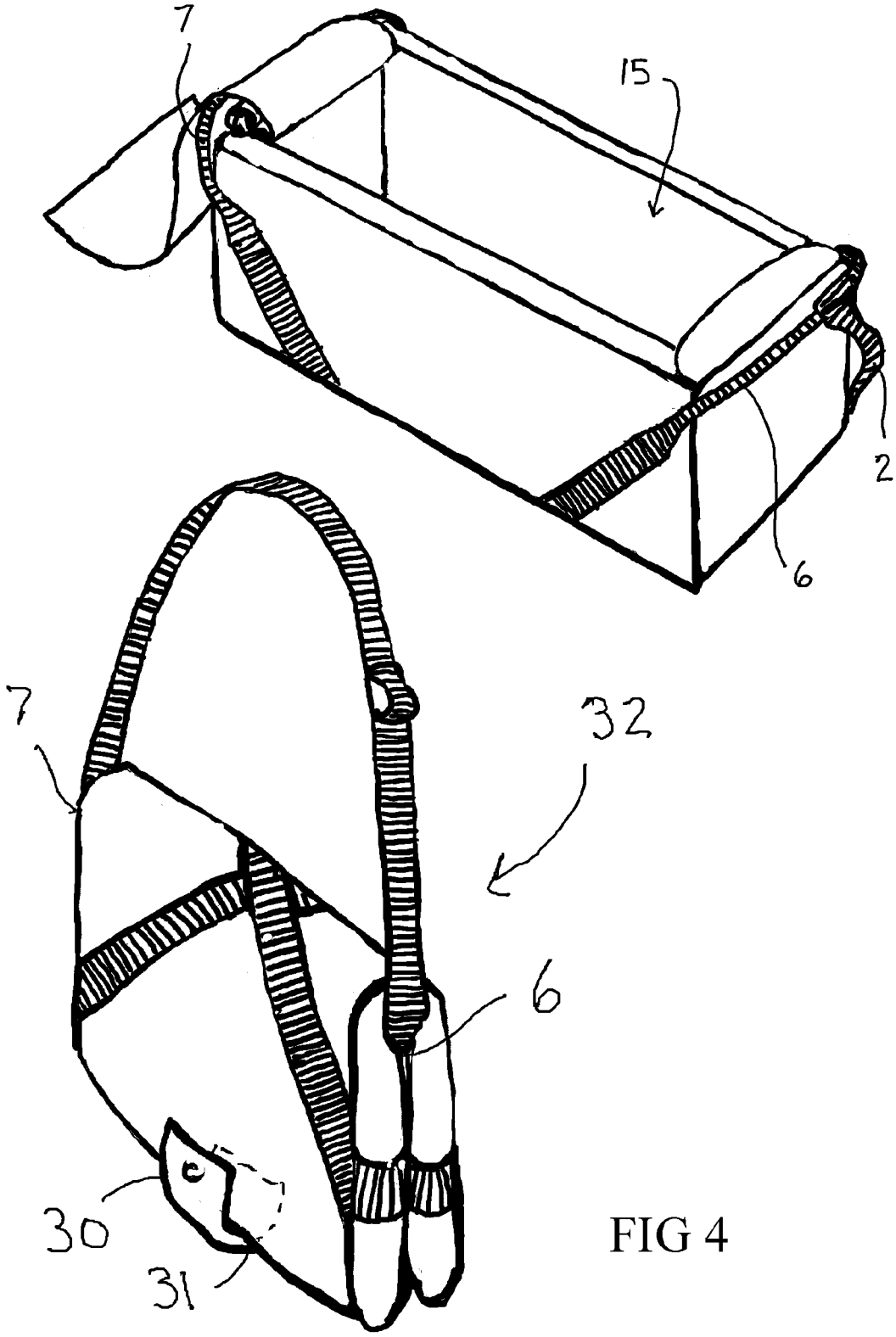
FIG. 4 is another perspective view of the second embodiment with the top panel open, which also shows the bag folded for storage.

The rescue bag may be formed by substantially connecting heat-resistant panels for a foot end, a head end, first and second sides, a bottom and a top. This may be done by sewing, gluing, adhering, welding, etc. as described herein. Furthermore, it may be done to the degree of air permeability or "air tightness" desired. Thus savings in fabrication time and/or costs may be realized if the bag is to be somewhat less "air-tight." In any event the panels must form an interior chamber for containing a person of the desired size and/or weight. The bag may then be undergirded with first and second support belts for bearing a portion of the weight of a person being rescued, with the support belts then being attached to the bag. Bails may be formed at the top of the bag from the ends of the support belts. The support belts may be formed as a single, substantially continuous component, if desired. Strap loops may be formed at front and rear portions of a strap, wherein the strap loops encircle the front and rear bails, respectively. A closure device is provided for the top panel that permits the interior chamber to be alternately closed and opened. As desired, a pressurized gas canister may be provided with the bag for producing an elevated gas pressure within the bag. The bag may be folded according to a selected pattern of creases and folds to provide a compact package for the bag when it is not in use. After folding the bag, and snapping it together or using other means such as latches, clamps, elastic bands, etc. for keeping the assembly folded, the strap remains exposed with respect to the assembly and available for use in transporting the bag. See FIG. 4, folded and snapped rescue bag 32.

FIGS. 8A and 8B are tables listing names of some of the components for the positive pressure infant/child rescue bag.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of this patent application The embodiments of the invention in which an exclusive property or privilege is claimed are defined as follows:

1. A rescue bag for a first person or persons to carry a second person, comprising: a bag having a foot end panel, a head end panel, first and second side panels, a bottom panel and a top panel, wherein the panels are substantially connected to form an interior chamber for containing the second person, wherein the panels are made of a heat-resistant material comprising an outer shell, a moisture vapor barrier and a thermal barrier; first and second support belts which substantially attach to and substantially undergird the bag; the first and second support belts forming front and rear bails at the top of the bag at the ends of the support belts; a strap connectable to the front and rear bails; a closure device for the top panel; wherein the top panel is capable of alternately closing and opening the entrance of the interior chamber when the top panel is moved by the first person; wherein when the second person is placed in the interior chamber of the bag and the top panel is closed, the second person is shielded when the bag is carried by the first person through a hazardous environment; and an auxiliary air line connection fitting, wherein the connection fitting connects to a self-contained breathing apparatus of the first person, further wherein the self-contained breathing apparatus maintains a pressure in the bag which is greater than atmospheric pressure when the interior chamber is closed.

2. The rescue bag of claim 1, wherein the closure device is a zipper.

3. The rescue bag of claim 1, wherein the closure device is selected from the group consisting of a zipper, snap, button, adhesive, interference fit, latch, clasp, zip like seal and hook-and-loop fastening material.

4. The rescue bag of claim 1, wherein the outer shell is made of a para aramid fiber blend "Ripstop" blend.

5. The rescue bag of claim 1, wherein the outer shell is made of a polybenzimidazole fiber.

6. The rescue bag of claim 1, wherein the outer shell has a water-repellent finish.

7. The rescue bag of claim 1, wherein the bag is capable of being transported by the first person or persons.

8. The rescue bag of claim 1, further comprising a compressed air canister, wherein the canister supplies air to the interior chamber.

9. The rescue bag of claim 8, wherein the canister maintains a pressure in the bag which is greater than atmospheric pressure when the interior chamber is closed.

10. The rescue bag of claim 1, the strap having a tie-off point or eyelet for a rope or cable to pass through the eyelet, wherein the eyelet is located substantially nearer the head end panel than the foot end panel.

11. The rescue bag of claim 1, the bag having sufficient venting at the zipper and hook and loop fasteners for passing gasses or air from the interior chamber to the atmosphere when the top panel is closed and bag is pressurized with gasses or air.

12. The rescue bag of claim 1, the bottom panel having a reinforcement, wherein the reinforcement supports and distributes at least a portion of the weight of the second person when carried in the bag by the first person.

13. The rescue bag of claim 1, wherein the bag is capable of having a light attached to it, wherein the light helps to locate the bag in low visibility conditions.

14. The rescue bag of claim 1, the bag having means for regulating a gas pressure in the interior chamber.

* * * * *